United States Patent [19]

Sokol

[11] Patent Number: 4,793,641

[45] Date of Patent: Dec. 27, 1988

[54] TAMPER REVEALING SEAL

[75] Inventor: Robert L. Sokol, Orland Park, Ill.

[73] Assignee: Panduit Corp., Tinley Park, Ill.

[21] Appl. No.: 59,724

[22] Filed: Jun. 9, 1987

[51] Int. Cl.[4] ..... B65D 55/06

[52] U.S. Cl. ..... 292/322

[58] Field of Search ..... 292/307 R, 307 A, 307 B, 292/318-320, 322, 316, 327; 24/16 PB, 289, 292, 297

[56] References Cited

U.S. PATENT DOCUMENTS

| | | | |
|---|---|---|---|
| 2,610,879 | 9/1952 | Pope | 292/320 |
| 3,518,727 | 7/1970 | Eberle et al. | 24/16 PB |
| 3,556,575 | 1/1971 | Farkas | 292/318 X |
| 3,758,060 | 9/1973 | Schuplin | 24/16 PB X |
| 3,955,842 | 5/1976 | Edwards | 292/307 R |
| 4,082,336 | 4/1978 | Natkins | 292/318 |
| 4,564,163 | 1/1986 | Barnett | 24/16 PB X |
| 4,697,833 | 10/1987 | Swift | 292/322 X |

*Primary Examiner*—Gary L. Smith
*Assistant Examiner*—Curtis B. Brueske
*Attorney, Agent, or Firm*—Charles R. Wentzel; Mark D. Hilliard

[57] ABSTRACT

Briefly, the seal of the present invention comprises a stud with resilient fingers that fit into a socket that contains shoulders so that when the stud is moved past the shoulders, the resilient fingers collapse and then spring out to engage the shoulders and prevent return movement. A pilot projection guides the resilient fingers into the socket and ensures their correct position relative to the shoulders both during insertion and attempted removal. The exteriors of the socket and the stud are to substantially fill apertures in the articles to be sealed. Once the socket and stud are positioned in the apertures, they cannot be removed without breaking the seal. The socket is made with a second opening normal to the opening of insertion of the stud so that the seal can be manufactured inexpensively and easily in a one step molding operation.

23 Claims, 5 Drawing Sheets

TAMPER REVEALING SEAL

BACKGROUND OF THE INVENTION

The present invention relates to devices used to seal or confirm the closure of objects wherein the seal can be made tamper resistant by placing it within aligned apertures formed in parts of the article desired to be sealed.

Seals presently being used for this purpose are generally made of molded plastic with a socket formed on one end of a strap and a stud formed on the other end. The socket is adapted for locking non-removable engagement when the strap is doubled over and the stud is pushed into the socket. Examples of this type of seal are disclosed in U.S. Pat. Nos. 3,466,077 and 4,001,919. One embodiment of this type of seal has the stud protruding above a medial portion of the strap with a hole in one end of the strap and a socket in the other. In this embodiment, the end of the strap with the hole is placed through the aperture in the article to be sealed and then doubled back and slipped over the stud. The socket end is then folded over and placed in locking arrangement over the stud to keep the end of the strap with the hole from being removed. This arrangement is disclosed in U.S. Pat. No. 4,441,233. The common aspect of all of these devices is that the seal is formed outside of the aperture or apertures of the article to be sealed, with the strap being placed through the aperture or apertures.

These strip type seals have proven useful in sealing objects such as mail sacks and railroad or truck doors where it is easy to place the strap in the aperture desired to be sealed. They are useful only if two or more apertures are not to be held in close proximity of each other. However, they are difficult to feed through and wind around apertures that have little hand clearance. Moreover, these prior art devices generally require a two step molding operation in order to make a socket with a solid head. The second step is needed to bend over portions of the socket or install a cap on the socket so that tamperers cannot place picks in the socket from the back side and pry back the locking fingers in the socket, thus allowing the socket to release and the object to be rifled.

Other problems with the prior art include the inability to disclose tampering by the clean cutting of the strap and subsequent reassembly by gluing or melting along the clean, barely discernable line.

Sealing devices should also be fairly easy to remove by authorized personnel. This is usually accomplished by making a weakened area in one portion of the strap to allow for seal breakage at that point. However, this weakened area should not be highly stressed during the installation or normal use of the seal in order to alleviate the possibility of undesired breakage during installation or use. Also, in the installation, there should be an audible snap when the resilient portions of the seal are set so that the installer knows that the seal is made. The seal should also maintain a slight tension between the resilient portions and the shoulder holding them in place so that movement of the seal will not cause inadvertent release of the seal. This slight tension should also help maintain the close proximity of two or more apertures when the seal is placed in the apertures, and will discourage surreptitious reconstruction of the seal.

The seal should also have a convenience portion for placing information concerning the merchandise that is within the article being sealed and have flanges above and below the latch to keep a pick from being able to remove the seal.

SUMMARY OF THE INVENTION

Among the several objects of the present invention may be noted the provision of an improved tamper revealing seal or device to confirm closure of an article, wherein the seal is made within an aperture that is desired to be sealed; the provision of a seal that is easy to place on articles containing apertures in areas of close tolerance; the provision of a seal that can be made highly tamper resistant without the need of a two step molding operation; the provision of a seal in which the stud remains in alignment with the socket even if one resilient leaf or finger of the stud is bent, removed or otherwise tampered with; the provision of a seal that contains flanges to thwart tamperers; the provision of a seal in which there is low stress on the predetermined breaking point during installation and normal use, makes an audible "snap" when properly installed and remains slightly stressed throughout its use; the provision of a seal that cannot be reformed without clearly visible signs that it was tampered with; and the provision of a seal that is easily removable by authorized persons.

Briefly, the seal of the present invention comprises a stud with resilient fingers that fit into a socket that contains shoulders so that when the stud is moved past the shoulders, the resilient fingers collapse and then spring out to engage the shoulders and prevent return movement. A pilot projection guides the resilient fingers into the socket and ensures their correct position relative to the shoulders both during insertion and attempted removal. The exteriors of the socket and the stud are to substantially fill apertures in the articles to be sealed. Once the socket and stud are positioned in the apertures, they cannot be removed without breaking the seal. The socket is made with a second opening normal to the opening of insertion of the stud so that the seal can be manufactured inexpensively and easily in a one step molding operation.

These and other objects of the invention will become apparent from the following detailed description taken in conjunction with the accompanying drawings in which like reference numbers designate like or corresponding parts throughout.

BRIEF DESCRIPTION OF THE FIGURES OF THE DRAWING

Corresponding reference characters indicate corresponding components of the present invention throughout the several views of the drawings.

DESCRIPTION OF THE PREFERRED EMBODIMENT

Figure 1:
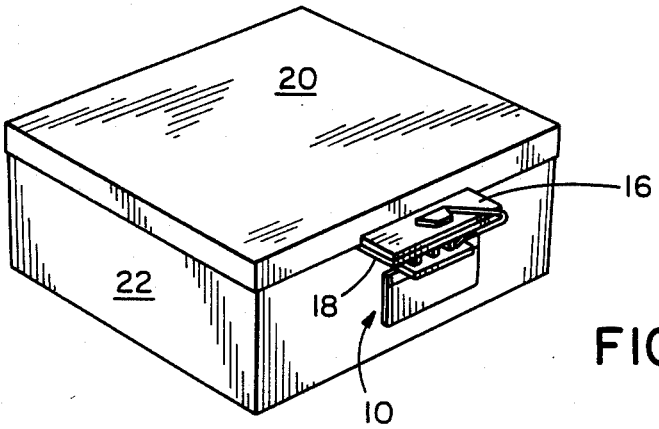
FIG. 1 is a perspective view of the seal applied to confirm the closure of a box and lid.
Figure 2:
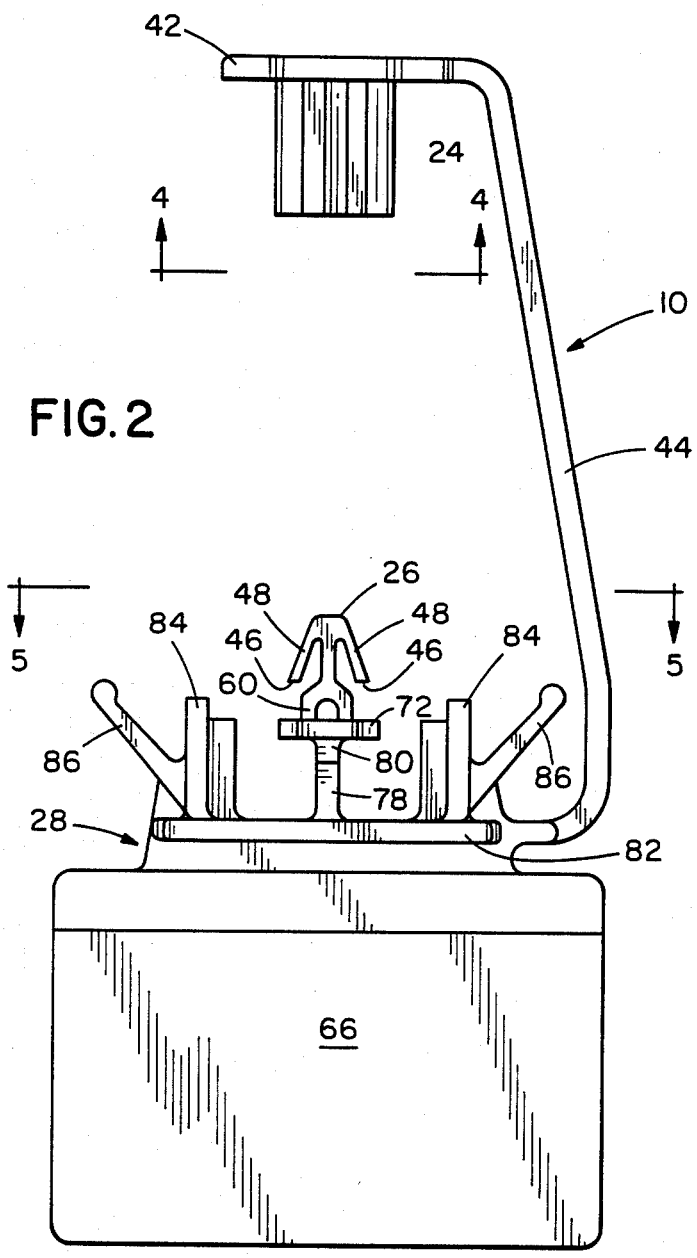
FIGS. 2 and 3 are, respectively front and side elevation views of an embodiment of the seal prior to insertion in an aperture of a box and lid to be sealed.
Figure 3:
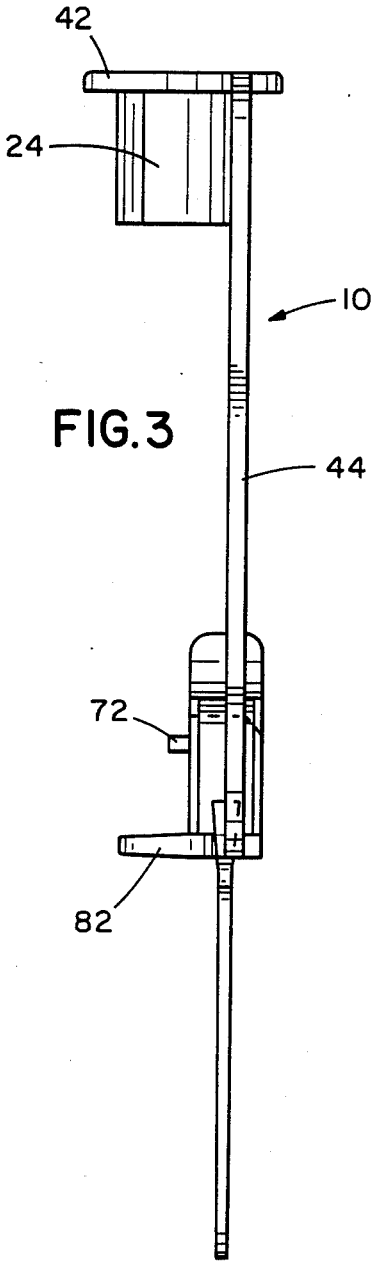

Referring now to the drawings, a device for forming a tamper revealing seal is generally indicated in FIGS. 1, 2 and 3 by reference number 10. FIG. 1 shows the seal 10 within two aligned apertures, best shown as 12 and 14 in FIGS. 8 and 9, in lips 16 and 18 protruding a short distance from the edges of a lid 20 and a box 22 acting as a seal of the lid 20 to the box 22. For example, the box 22 may be used to hold money, and it would be desired to have the lid 20 sealed to the box 22 when the box, containing a predetermined amount of money, is transported from one location to another.

Figure 9:
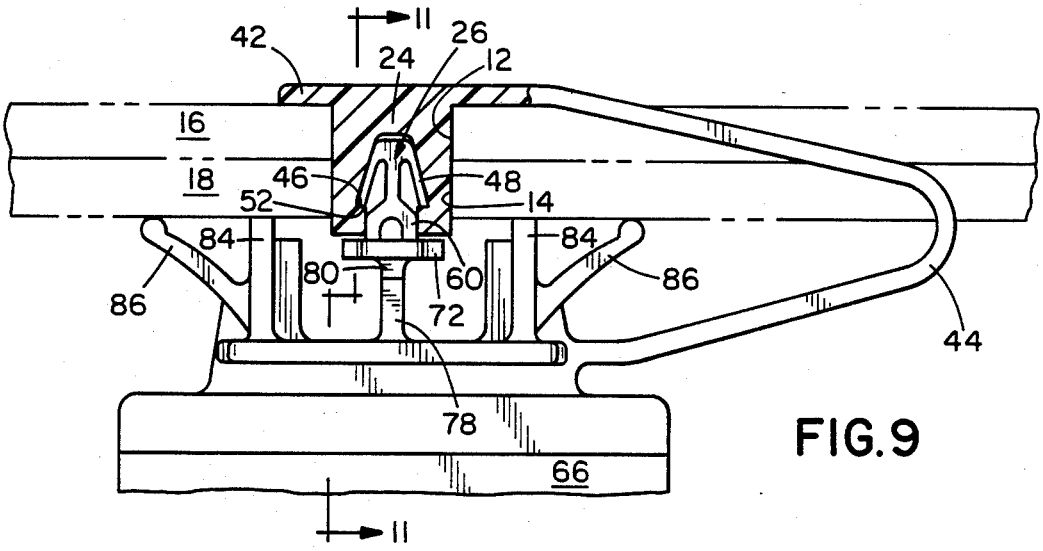
FIG. 9, similar to FIG. 8 is a front elevation view, partially cut away, showing the seal assembled with the first locking member in locked engagement with the stud.

In one embodiment, the seal 10 generally includes a first locking member in the form of a socket or catch 24 and a second locking member in the form of a stud or latch 26 positioned on a bottom portion 28. As can be seen in FIG. 9, the socket 24 and the stud 26 cooperate to form a latch mechanism when the stud 26 is inserted into the socket 24.

Figure 8:
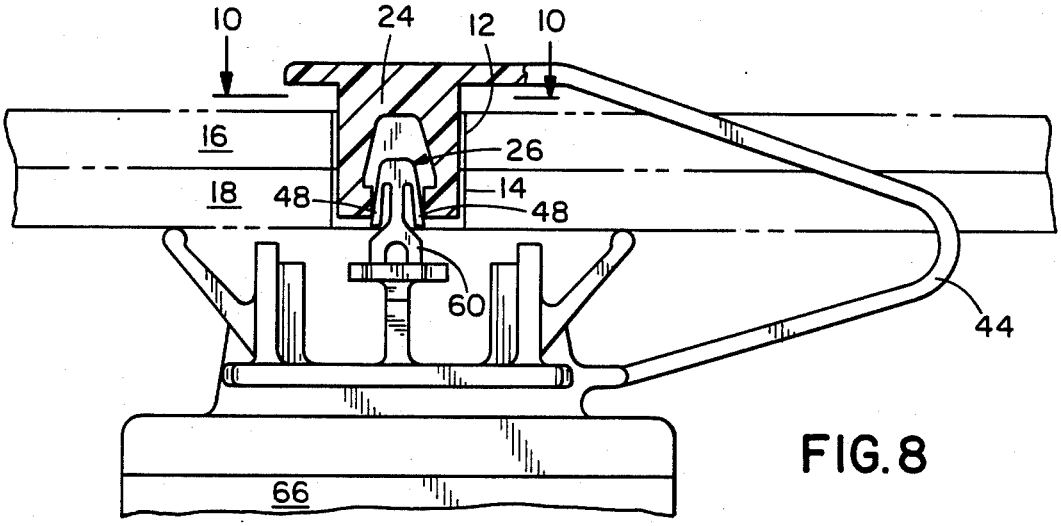
FIG. 8 is a front elevation view, partially cut away, showing the first locking member being inserted onto the stud.
Figure 10:
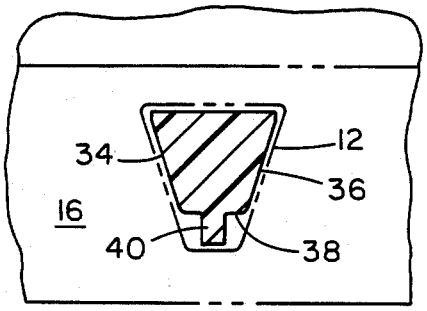
FIG. 10 is a partial sectional view of the first locking member taken along line 10—10 of FIG. 8.
Figure 11:
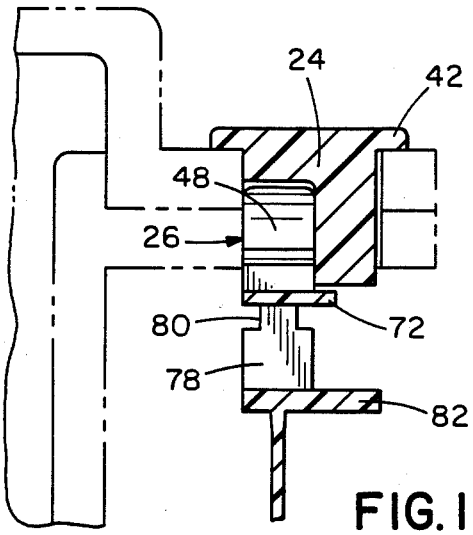
FIG. 11 is a partial sectional view of the seal taken along line 11—11 of FIG. 9.

In FIGS. 8, 9 and 10, it can be seen that the exterior of the first locking member or socket 24 should be dimensioned so that the socket or catch 24 is in a loose fit engagement with the aligned apertures 12 and 14, when the seal is assembled. Either the exterior of the socket 24 can be in contact with the walls of the apertures 12 and 14 as shown in FIG. 9 or a small space can be allowed around the socket 24 as shown in FIG. 8 so that the socket will easily slip into the holes 12 and 14 for ease of assembly of the seal on the box and lid. It should also be understood that the device contained in the present invention will also be effective in sealing objects containing a single aperture as long as the aperture has sufficient depth to substantially cover the socket 24.

When viewed from above, as in FIG. 10, in a preferred embodiment, the shape of the cooperating apertures 12 and 14 is trapezoidal. The side walls 34 and 36 of the socket 24 are constructed to be made in a cooperating configuration to mate with the walls of the apertures 12 and 14. The front side or nose 38 of the socket may be constructed with a vertical flange 40. The depth of the vertical flange 40 can be easily altered in the molding operation used to construct the seal to conform to slight variations in the apertures 12 and 14 and the amount of play between the socket and the apertures 12 and 14 preferred by persons installing the device. In other words, the depth of the vertical flange 40 can be varied slightly to determine how snugly the socket will fit in the holes 12 and 14.

A horizontal flange 42 covers the top of the socket 24 and extends transversely in at least one direction. When the seal is in use, the flange 42 extends over the top of the lip 16 of the lid in at least one direction so that the socket 24 cannot pass through either of the holes or apertures in the lips 12 and 14. In the preferred embodiment, this horizontal flange 42 extends laterally over the lip 16 in all directions to act as an added barrier against the insertion of tools into the socket to attempt a surreptitious disengagement of the latch mechanism.

An umbilical cord or runner 44 extends from the socket 24 to connect the stud 26. In certain embodiments, the runner may be eliminated and first locking members or sockets 2 of varying shapes and sizes may be used with a single second locking member or stud 26 depending upon the shape and size of the holes 12 and 14 that the socket 24 must fit. However, a runner 44 is beneficial in keeping the first locking member attached to the bottom portion 24 of the seal prior to use so that one of the pieces is not inadvertently misplaced. Additionally the runner ensures that the correct socket and stud are used together.

Figure 6:
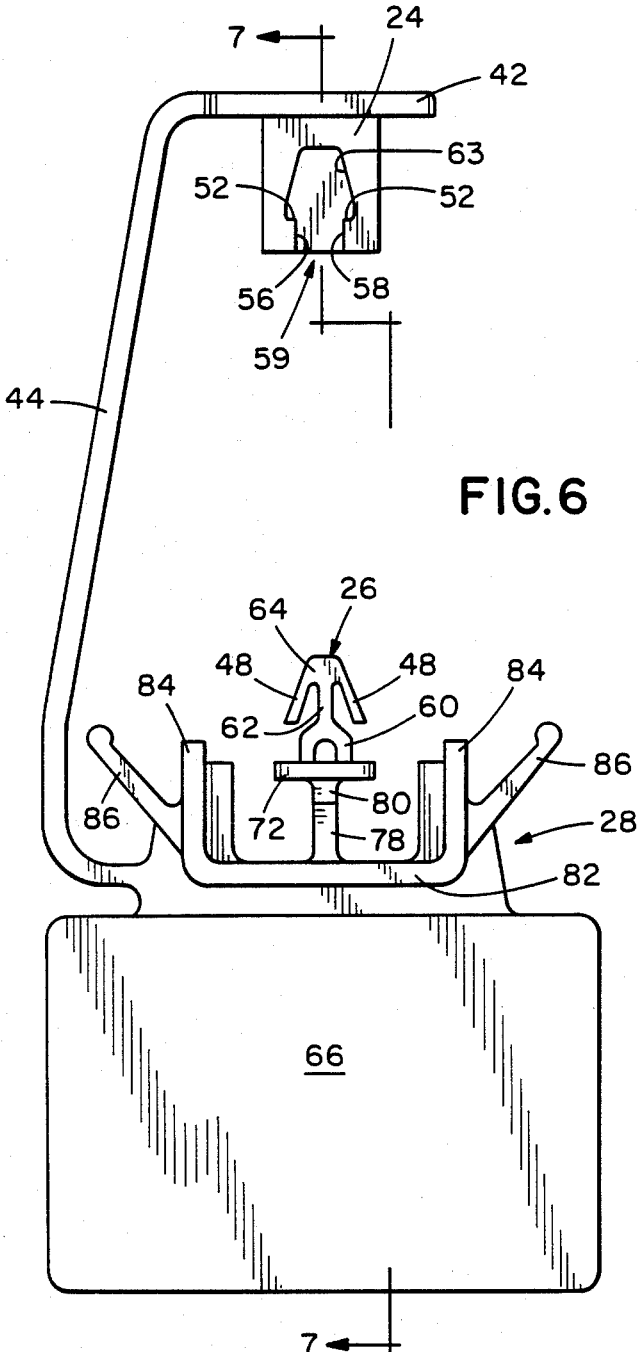
FIG. 6 is a back elevation view of the embodiment shown in FIGS. 2 and 3.

In use, the socket or catch 24 cooperates with a stud or latch 26 to form a secure latch mechanism by means of the bottom edges 46 of fingers 48 on the stud 26 cooperating with the top surfaces of shoulders 52 in the socket. The inside walls of the socket 24 are shaped to form the catch portion of the latch mechanism. The two bottom walls 56, 58, as shown in FIG. 6, of the socket are spaced a distance apart to define a first opening 59 in the bottom of the socket. The width of the first opening 59 will allow the stud 26 to pass through in a vertical motion only if the resilient fingers 48 of the stud 26 are flexed inwardly, as shown in FIG. 8.

In addition, the distance between the bottom walls 56 and 58, or the width of the first opening 59, is such that these walls cooperate with the pedestal 60 of the stud 26 to form a fairly tight fit when the socket 24 is fully positioned on the stud 26. This acts as a further deterrent to any attempt to place a pry tool between the socket 24 and the stud 26 while latched to attempt to surreptitiously disengage the seal.

Once the socket 24 is slipped completely over the stud 26, the resilient fingers 48 will spring back to their natural position as shown in FIG. 9 with the bottom edges 46 positioned above and in contact with the top surfaces of shoulders 52 of the socket 24. Thus, once in place, the socket 24 cannot be removed vertically from the stud 26 because a secure connection is formed between the socket 24 and the stud 26.

The stud or latch 26 is constructed with a center post 62 upstanding from the stud pedestal 60. At the top of the center post 62 is a head portion 64. Depending diagonally downwardly from the head is at least one resilient finger 48 that will flex when assembled to the socket or catch 24 as described above to define a latch mechanism. Above the shoulders 52 in the interior of the socket is at least one sloping wall 63 that is generally sloping at an angle complementary to the slope of an adjacent resilient finger 46. When the socket 24 is pressed over the stud 26 and the resilient fingers 48 spring back to their natural position, they strike the sloping walls 63 and make an audible "snap" to inform the installer that the seal has been effected.

As stated earlier, the pedestal 60 is dimensioned to fit snugly into the first opening 59 or the space between the bottom walls 56 and 58 of the socket when the seal is made. Not only does this assist in preventing tampering of the seal with a tool, but it also holds the socket 24 in a secure position on the stud 26 to reduce the chances that jostling of the second locking member by grasping the name plate 66 can inadvertently cause release of the seal.

Figure 4:
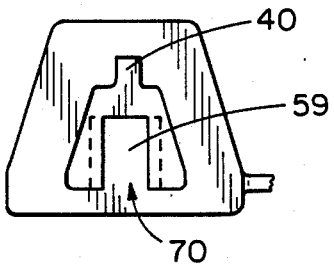
FIG. 4 is a bottom elevation view of the first locking member of the seal as seen from line 4—4 of FIG. 2
Figure 5:
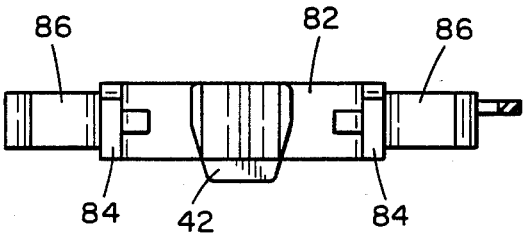
FIG. 5 is a plan view of the second locking member as seen from line 5—5 of FIG. 2.
Figure 7:
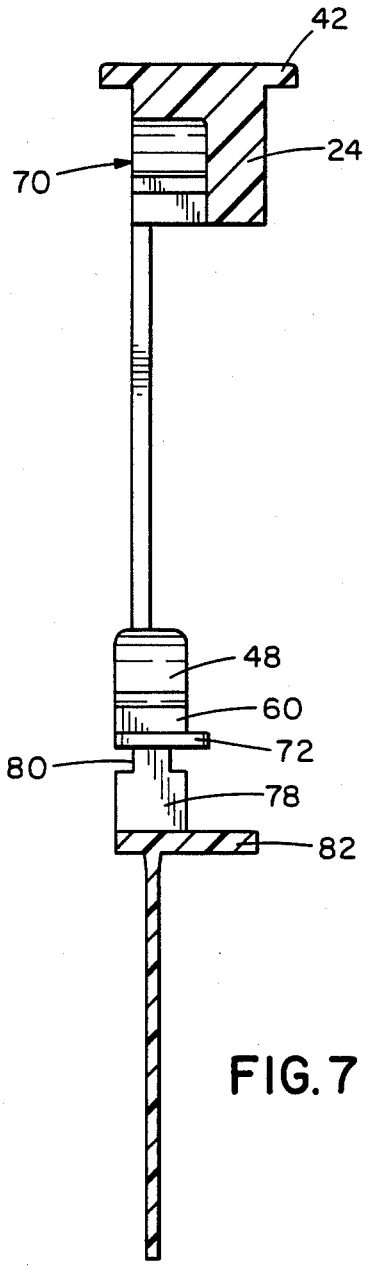
FIG. 7 is a sectional view taken along line 7—7 of FIG. 6.

As can be seen in FIGS. 4 and 7, the socket 24 contains a second opening 70 normal to the first opening 59 in the bottom of the socket 24. The shape of the second opening 70 is similar to the interior arrangement of the socket 24 and is viewed in FIG. 6. Thus, in the absence of the wall of the holes 12 and 14 of the article to be sealed, the stud 26 could be removed horizontally from the socket by sliding the stud 26 from out of the socket through the second opening 70. However, since the exterior of the socket 24 is dimensioned to fit snugly in the holes 12 and 14, there is minimal clearance between the socket 24 and the mating walls of the lips 16 and 18, thus, in use, the stud cannot be removed in this manner.

This second opening 70 allows the seal to be manufactured in a one step molding operation while having the area above the shoulders 52 in the socket 24 sealed, unlike the prior art devices. As can be readily appreciated by viewing FIGS. 6 and 7, a mold with horizontal movement could readily be used to manufacture the seal 10 without the need of mold pins moving in a normal direction or a secondary operation to fill a void above the shoulders 52 of the socket 24 that are needed to form the latch or form the area between the stud center post 62 and the fingers 48 needed to form the stud.

Immediately below the stud center post 62 and the stud pedestal 60 is a stud platform 72. The horizontal dimensions of this platform are roughly the same as the exterior dimensions of the socket 24. Thus, the lateral dimensions of the stud platform 72 are larger than the bottom or first opening 59 of the socket 24 and the top surface of the platform is either in close proximity or mating with the bottom surface of the socket when the seal is in the closed or sealed position.

As can be seen in FIG. 9, the close proximity of the top surface of the stud platform 72 with the bottom wall of the socket 24, and the close proximity of the exterior of the stud pedestal 60 with the bottom interior walls of the socket and the immediate right angle between these combinations of walls causes little clearance or room for a pick or other tool to be able to enter into the latch mechanism and jimmy the fingers 48 of the stud 26 away from their latched position.

Figure 12:
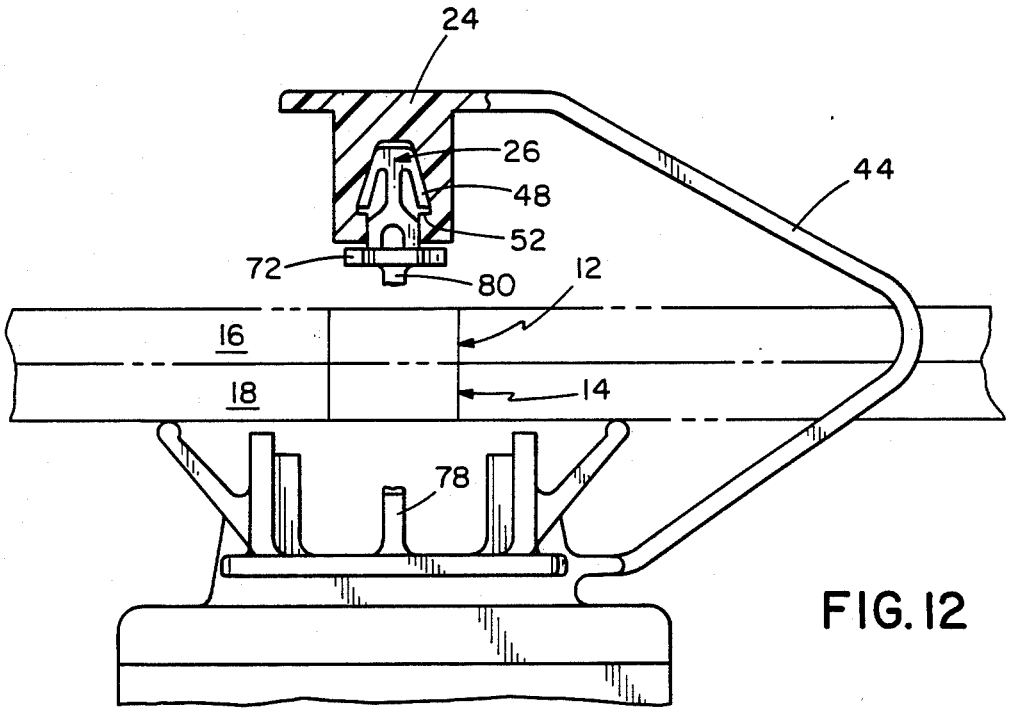
FIG. 12, similar to FIGS. 8 and 9 is a front elevation view, partially cut away, showing the seal after it is broken and the first locking member is removed from the aligned apertures.

The lateral dimensions of the stud platform 72 cannot be larger than the interior dimensions of the apertures 12 and 14 of the article to be sealed because the platform 72 must be able to be removed through the apertures 12 and 14 when the seal is intentionally broken after use by severing the stud holder post 78, as shown in FIG. 12.

Depending from the bottom portion 28 of the seal 10 is an optional name plate or identification tag 66. This can be made with pre-embossed numbers or letters, or made with a matt finish to allow post manufacture lettering or the adhesion of a label. The identification tag 66 should also be large and sturdy enough to allow a hand to grasp the tag, and with a twisting or pulling action break the seal. The seal can also be easily removed or broken by clipping the seal at the designated break-off location 80 in the stud holder post 78. In either case, the seal should break at the designated break-off location 80, which is an area of reduced cross section in the stud holder post 78, and the socket 24, with the stud 26 inserted within, can be removed from the top of the apertures 12 and 14 and the remainder of the seal can be removed from the bottom of the apertures 12 and 14 as shown in FIG. 12. Preferably both sides will still be attached by means of the runner 44 for easy disposal.

Positioned above the identification tag 66 is a horizontal shelf 82, which acts as a platform for the upward extension of anti-rotation flanges 84 and biasing arms 86. In addition, the shelf also acts as a finger hold when inserting the bottom portion 28 of the seal into the apertures 12 and 14. Using the shelf 82 to guide the stud into the apertures 12 and 14, by use of ones fingers, one can then use a thumb of the sam hand to push the socket 24 down through the aperture 12 and 14 and onto the stud 26. Thus, the seal can be made by using only one hand, even in apertures with close clearances around them.

The present construction also allows the weakened portion 80 of the stud holder post 78 to not be highly stressed in shear or tension during installation of the seal. When installing the device, the socket 24 is pushed into the apertures and the stud 26 inserted into the socket. Thus, the stud holder post 78 is put in slight compression, and no tension or shearing forces are placed upon it that could lead to its inadvertent breakage during installation.

As best seen in FIG. 9, a pair of anti-rotation flanges 84 are essentially vertical and spaced laterally from the stud holder post 78. The anti-rotation flanges are positioned at a designated width so that they can contact the bottom surface of the lip 18 of the box 22 or other object to be sealed when the bottom portion 28 of the seal is attempted to be rotated. This helps alleviate any accidental stresses on the stud post if the identification tag 66 is inadvertently twisted so that the seal cannot be accidentally broken. The anti-rotation flanges 84 are also spaced a sufficient distance from the stud holder post 78 to allow a cutting tool such as cutting pliers or scissors to be inserted between the anti-rotation flanges 84 in order to cut the stud post 78, preferably at the weakened portion 80, for easy removal.

Spaced laterally outward from the anti-rotation flange 84 along the shelf 82 and extending diagonally upward are a pair of biasing arms 86. When the seal 10 is in the locked position, as seen in FIG. 9, the biasing arms 86 deflect slightly on the bottom surface of the lip 18 in the box 22 or other object to be sealed to place a slight downwardly biasing stress on the stud 26 while caught in the socket 24. This acts to keep contact between the bottom edges 46 of the stud fingers 48 and the top surface of the socket shoulder 52 reducing the possibility that the latch 30 formed by their contact will become loosened by jostling or jimmying.

This slight stress also aids in making the seal difficult to be surreptitiously reconstructed once the weakened area 80 is broken. Preferably, the seal 10, along with the stud holder post 78 is made of polypropylene or other material that is not conducive to being held together by an adhesive, especially when put in a tension stress. Thus, the slight stress on the stud holder post 78 asserted by the biasing arms 86 will discourage attempts to glue together a stud holding post 78 that has been cut.

Figure 13:
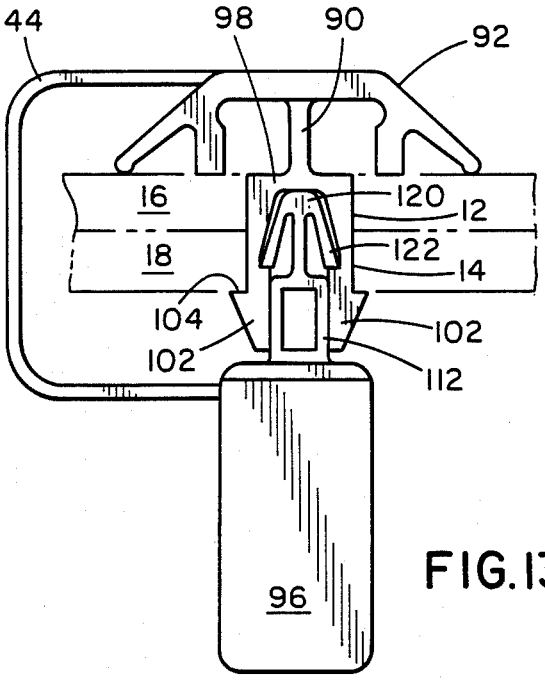
FIG. 13 is a sectional view of another embodiment of the herein invention showing a double latch.
Figure 14:
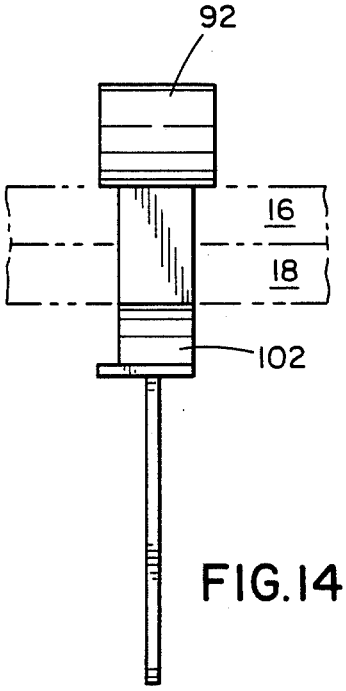
FIG. 14 is a side elevation view of the embodiment shown in FIG. 13.

FIGS. 13 and 14 disclose an alternative embodiment of the invention that has a designated break-off post 90 above the lips 16 and 18. In this embodiment, the seal can be removed from the apertures 12 and 14 after use by cutting the break-off post 90 by use of a suitable tool such as clipper pliers or scissors. The top cap 92 would then be allowed to rise up and the remainder of the seal would be allowed to be pulled from out of the apertures 12 and 14 by grasping the identification tag 96 and pulling downward.

This alternative embodiment is also characterized by a double latch mechanism. A two part operation is needed to install the seal shown in FIGS. 13 and 14. In the first step, the first locking member or socket 98 is inserted through the aligned apertures 12 and 14. This first locking member is constructed with an exterior latch on the bottom portion. When the first locking member is inserted into the apertures 12 and 14, the resilient legs 102 will deflect inwardly to allow the exterior portion 104 depending from the legs to pass through the apertures 12 and 14. Once in position, the legs 102 will spring outwardly and the exterior portion 104 will contact the bottom surface of the lip 18 of the box to be sealed acting as a first latch.

Once the first locking member 98 is placed within the apertures 12 and 14 as described above, the second locking member 112 can be inserted upwardly through the opening between the legs 102 and into the interior of the first locking member 98. The interior of the first locking member 98 is shaped similar to the interior of the socket or first locking member 24 previously described and also contains a second opening through the back side of the first locking member for ease of manufacture. In addition, the second locking member 112 has a stud portion 120 that has resilient fingers 122 similar to those described in the previous embodiment.

The embodiment disclosed in FIGS. 13 and 14 is preferably used in non-trapezoidal shaped holes because the exterior latch on the first locking member is difficult to manufacture and install in trapezoidal shaped holes due to the sloped walls inherent in that shape. This embodiment works well in square or rectangularly shaped apertures and provides a double secure latch, and a break-off post above the aperture for easy removal in addition to the other advantages described in the first embodiment.

As a result of testing the embodiment disclosed in FIGS. 1–12, under certain conditions it was possible to have only one of the fingers 48 latch behind a shoulder 52 in the socket. When this happened, it was further possible to manipulate and rotate the stud 26 and remove the stud from the socket without visible damage to the stud.

Figure 15:
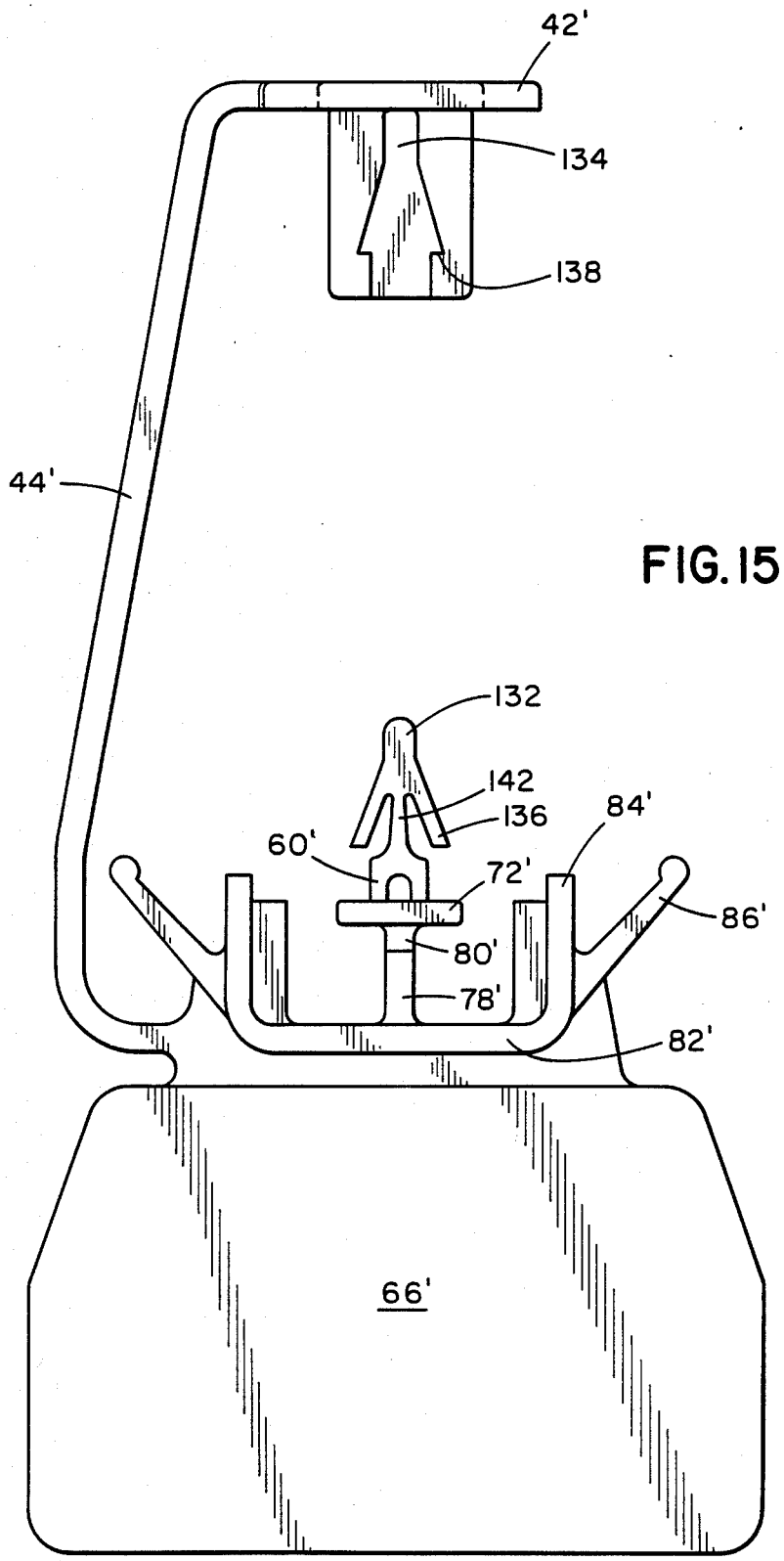
FIG. 15 is an elevation view of an improved embodiment.

The embodiment set forth in FIG. 15 eliminates these problems by having means to prevent rotation in the form of a pilot projection 132 for mating engagement in a pilot aperture 134 in the socket. When the pilot projection 132 is positioned in the pilot aperture 13, it will be appreciated that even if only one of the fingers 136 has snapped into locking engagement with one of the shoulders 138, the stud may not be rotated and accordingly the finger cannot be removed from the shoulder without destruction of the seal.

As in the prior embodiment, the stud is provided with an area of reduced cross section which provides a designated break-off 80' comprising the weakest area under tension of the assembled seal. Functionally similar parts are marked with the same reference numerals as FIGS. 1–12 with a prime being added. Additionally, the embodiment shown in FIG. 15 is provided with a secondary failure point. The stud center post 142 tapers to a section of reduced width at the point it joins the fingers 136.

Accordingly, if an individual were to tamper with the seal by engaging the stud platform 72' so as to eliminate stress on the break-off 80', it will be appreciated that the stud center post 142 will fail before the fingers 136 become disengaged from the shoulders 138.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

I claim:

1. A security seal for positioning in openings of articles to be sealed together, said seal comprising first and second locking members, one of said locking members comprising a socket and the other of said locking members comprising a stud dimensioned to allow the stud to be positioned in the socket in non-removable engagement therewith, one of said stud and socket having at least one resilient finger, the other of said stud and socket having a shoulder wherein said finger is adapted to be resiliently urged past said shoulder whereupon said finger will spring out so as to engage said shoulder and prevent return movement, said socket having a stud receiving opening therein for receiving said stud in a first direction and an additional opening therein transverse to the direction of insertion of said stud which additional opening is sealed by the articles to be sealed when said socket is positioned in said openings of articles to be sealed, said stud being removable from said socket through said additional opening when said seal is spaced from said articles, said locking members further comprising flange means for engaging the articles to be sealed to maintain their position in said openings when assembled.

2. A seal as set forth n claim 1 wherein an anti-rotation flange is positioned on the side of the stud and adapted to engage a wall of the article to be sealed so as to prevent undue stress on the stud.

3. A seal as set forth in claim 1 wherein a pair of biasing arms are positioned on the sides of said stud to engage the wall of the article to be sealed and urge said stud away from said socket whereby said stud is under tension when assembled in said socket.

4. A seal as set forth in claim 1 wherein said shoulder is aligned with said additional opening said locking members further comprise means for preventing relative rotation.

5. A seal as set forth in claim 1 wherein the stud has a flange extending transversely of the opening in the socket that is adapted to sea the opening in said socket when the stud and socket are assembled.

6. A seal as set forth in claim 1 wherein the stud is positioned on a stud pedestal dimensioned to close the stud receiving opening when said stud and said socket are assembled whereby egress to said stud receiving opening is limited.

7. A seal as set forth in claim 4 wherein the means for preventing relative rotation comprises a pilot projection on said stud and an aperture in said socket.

8. A seal as set forth in claim 1 wherein the first and second locking members are attached by means of a thin strand of material.

9. A seal as set forth in claim 1 wherein one of either the stud or the socket is attached to a post containing a predetermined weakened section adapted to fail prior to removal of said stud from said socket.

10. A seal as set forth in claim 1 wherein the socket contains an exterior vertical flange for dimensioning the socket for a snug fit in said openings of the articles to be sealed.

11. A seal as set forth in claim 1 wherein the seal is constructed of material that is not conducive to being held together by an adhesive.

12. A seal as set forth in claim 1 wherein the resilience of said finger forces the finger to spring out with sufficient velocity to create an audible snapping sound.

13. A seal as set forth in claim 1 wherein the first locking member further comprises resilient exterior feet adapted to latch onto one of the two said articles to be sealed adjacent the hole in said article to be sealed.

14. A seal for placement in apertures of objects whose closure is to be confirmed, said device comprising first and second locking members and a bottom portion, one of said locking members defining a catch means having a fist and a second opening, said first opening being aligned with said apertures and said second opening being normal to said apertures when said device is placed in said apertures, the other of said locking members defining a latch means dimensioned to fit substantially within and be in locking engagement with said catch means when placed within said catch means when said catch means is positioned within said apertures of objects whose closure is to be confirmed, one of said locking members also comprising a flange extending transversely to cover one end of said apertures, and said bottom portion comprising a flange extending transversely to cover the other end of said apertures and a neck for attachment to said other locking member.

15. A seal as set forth in claim 14 wherein an anti-rotation flange is positioned on the bottom portion and adapted to engage a wall of the object so as to prevent undue stress on the neck.

16. A seal as set forth in claim 14 wherein at least a pair of biasing arms are positioned on the bottom portion and adapted to engage a wall of the object and urge said other locking member away from said one of said locking members whereby the other of said locking members is under tension when assembled in said one of said locking members.

17. A seal as set forth in claim 14 wherein the other of said members contains a flange extending transversely away from said one of said locking members that is adapted to seal said first opening when said one and said other locking members are engaged.

18. A seal as set forth in claim 14 wherein the other of said locking members is positioned on a pedestal dimensioned to substantially close said first opening.

19. A seal as set forth in claim 14 wherein said first and second locking members are attached by a thin strand of material.

20. A seal as set forth in claim 14 wherein the neck comprises a predetermined weakened section adapted to fail prior to removal of said latch from said catch.

21. A seal as set forth in claim 14 wherein the device is constructed of material that is not conducive to being held together by an adhesive.

22. A seal as set forth in claim 14 wherein the first locking member further comprises resilient exterior feet adapted to latch onto one of said objects adjacent one of said apertures.

23. A seal as set forth in claim 22 wherein said other of said locking members further comprises a post to connect the other of said locking members to said flange on said bottom portion.

* * * * *